United States Patent [19]

Wilson

[11] Patent Number: 4,538,854

[45] Date of Patent: Sep. 3, 1985

[54] ELEVATOR CHAIR

[75] Inventor: Ross E. Wilson, Guelph, Canada

[73] Assignee: Morette's Limited, Hillsburgh, Canada

[21] Appl. No.: 449,177

[22] Filed: Dec. 13, 1982

[51] Int. Cl.[3] ..... A47C 1/02

[52] U.S. Cl. ..... 297/345; 297/347; 297/DIG. 3; 297/DIG. 8

[58] Field of Search ..... 181/198, 205, 202; 297/345, 347, DIG. 3, DIG. 10, DIG. 8

[56] References Cited

U.S. PATENT DOCUMENTS

| | | | |
|---|---|---|---|
| 2,817,096 | 12/1957 | Roth | 297/345 X |
| 3,500,954 | 3/1970 | Willette | 181/232 |
| 3,789,954 | 2/1974 | Raleigh | 181/205 |
| 4,046,348 | 9/1977 | Goodwin | 297/345 X |

FOREIGN PATENT DOCUMENTS

| | | | |
|---|---|---|---|
| 2844628 | 4/1980 | Fed. Rep. of Germany | 297/DIG. 6 |
| 3119867 | 12/1982 | Fed. Rep. of Germany | 297/DIG. 6 |
| 2333472 | 7/1977 | France | 297/345 |

*Primary Examiner*—James T. McCall
*Attorney, Agent, or Firm*—Sim & McBurney

[57] ABSTRACT

There is provided a chair having a seat portion and an inflatable member under the seat portion. Enveloped by the inflatable member is means for bringing outside air into the inflatable member to inflate it and thus raise the seat portion. In a preferred form, an electrically powered vacuum device would be located within a bag constituting the inflatable member, and thus the bag itself would contribute to muffling the sound of the electrically powered vacuum device.

9 Claims, 5 Drawing Figures

ELEVATOR CHAIR

This invention relates generally to chairs having seats that can be raised and lowered while the occupant is sitting on the seat, and has particularly to do with a chair of this kind in which the force for raising the seat is derived pneumatically.

It is well known that there are many afflictions which can cause weakness in the legs and render the afflicted person unable to rise to a standing position after having sat in a chair, couch or the like. Leg weakness particularly affects many older people, and there are others who are crippled from birth or afflicted with diseases such as Muscular Dystrophy, who also find it very difficult to return to a standing position from a seated position.

BACKGROUND OF THIS INVENTION

Certain special chairs have been manufactured, in which it is possible to raise the seat and then lower it again, in order to allow the occupant to regain a standing position without straining the leg muscles. One such chair is described in U.S. Pat. No. 3,915,494, issued Oct. 28, 1975 to David Somerset. The Somerset chair is one in which the seat frame is guided along a path inclined forwardly from the vertical, so that raising and lowering movement of the seat frame is accompanied by forward and backward movement respectively. The raising of the seat frame is accomplished by means of cables passing over a complicated array of pulleys, and reeled in on a capstan which is rotated at a slow speed through a speed-reducing mechanism by an electrical motor mounted in the base of the chair.

Besides being quite expensive, the Somerset structure has a large number of critical moving parts, pulleys, slideways and the like, of which the malfunctioning of even one can result in jamming or inoperability of the chair.

It is an aim of one aspect of this invention to provide a chair structure in which the seat portion is capable of being raised and lowered, but which is such that it can be manufactured very inexpensively from standard and easily obtained parts, and which in particular avoids mechanical complexity by using a pneumatically powered air bag to accomplish the raising of the seat.

GENERAL DESCRIPTION OF THIS INVENTION

In its simplest form, this invention provides a chair which includes a seat portion, an inflatable member under the seat portion, and means enveloped by the inflatable member for bringing outside air into the member to inflate the same and to raise the seat portion. By enveloping the air-drawing means with the inflatable member, the inflatable member can act at least in part as a muffling device in order to cut down the sound which the air-drawing means generates.

In a preferred embodiment, the chair includes a seat portion mounted to be moveable between a lower position and a higher position, and an inflatable bag means under the seat portion. Motorized means are located within the bag member for drawing outside air into the bag member to inflate the same and raise the seat portion, so that the noise from the motorized means is at least partly muffled by the bag member.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
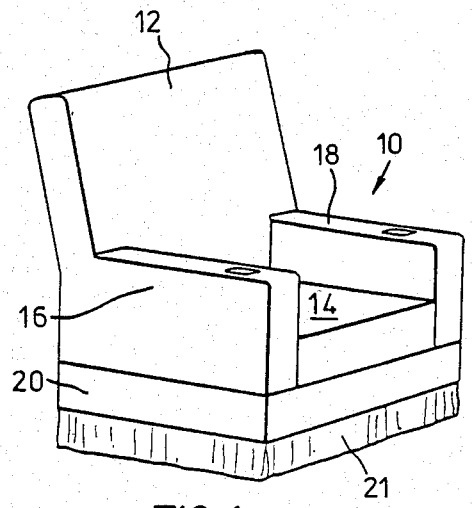
FIG. 1 is a perspective view of a chair embodying this invention, in its lower position.

In FIG. 1 there is shown a chair 10 which includes a back support 12, a seat portion 14, side arms 16 and 18, an under structure 20, and a fabric skirt 21.

Figure 2:
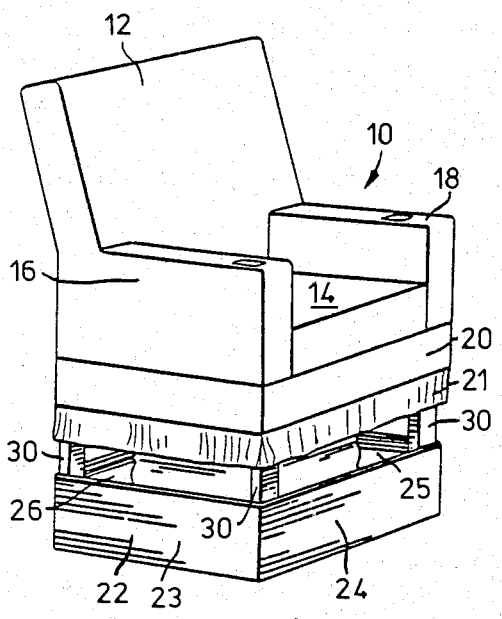
FIG. 2 is a perspecitve view of the chair of FIG. 1 in the higher position.
Figure 3:
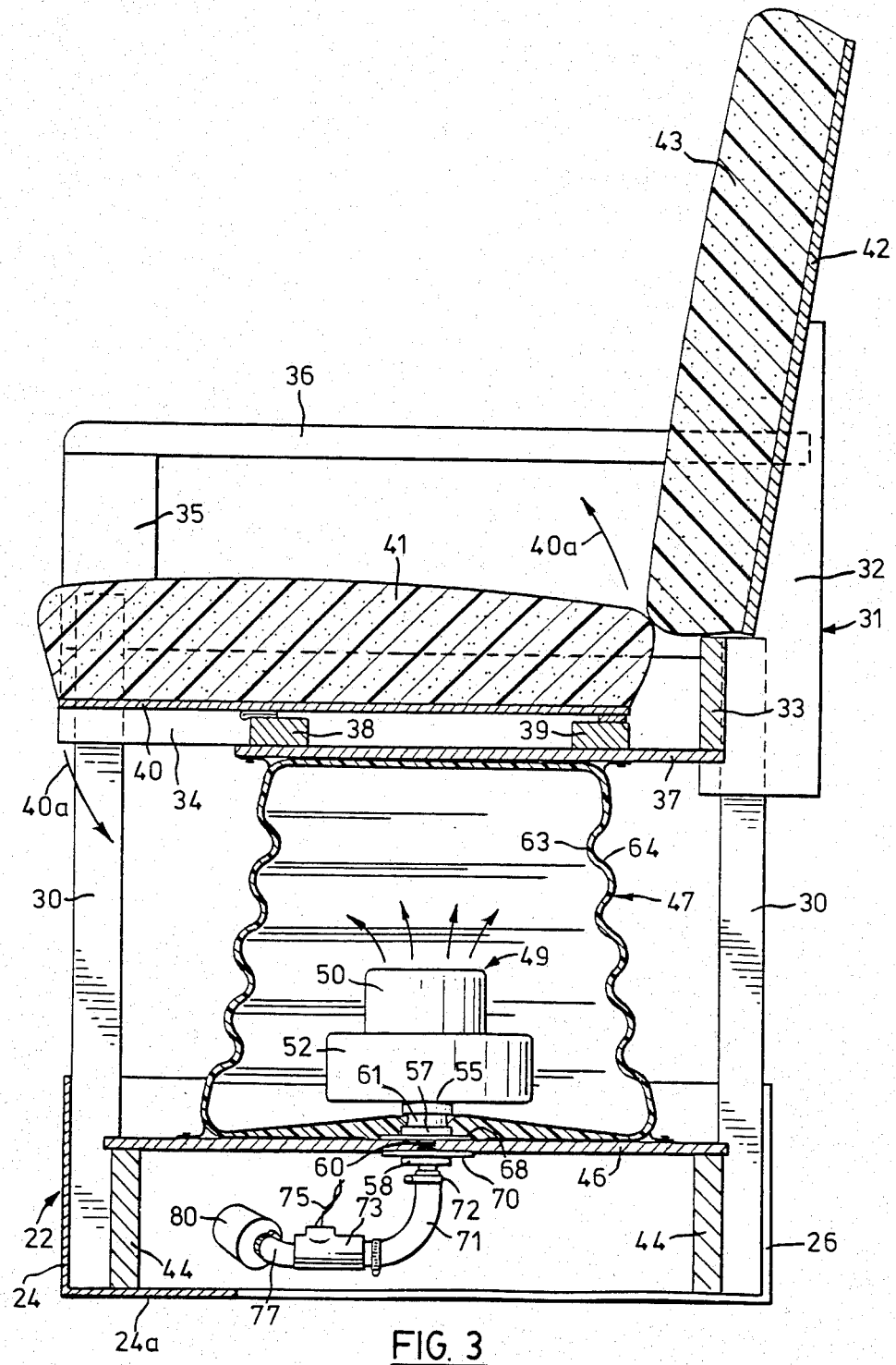
FIG. 3 is a sectional view taken through the base and seat portion of the chair of FIG. 1.

In FIG. 2 the chair 10 is shown raised to its uppermost position. In this position, there is revealed a base 22 which includes three rectangular metal panels 23, 24 and 25, together with trapezoidal back panels 26 and 28. Each of the panels 23–28 is integral along its lowe edge with an inwardly projecting bottom flange. In FIG. 3 the flange **24*a* of the front panel 24** can be seen in section.

In FIG. 2 there can be seen, extending vertically upwardly from the four corners of the base 22, three or four telescopingly extensible support members 30, which may coveniently be constituted by glide rails of the kind utilized in filing cabinets. These glide rails 30 typically use ball bearings to reduce friction. Since the glide rails are of conventional nature, there is no need to describe them in detail in this specification, beyond pointing out that the support members 30 are welded or otherwise securely fastened in the four corners of the base 22.

Referring now to FIG. 3, the tops of the support members 30 are affixed to a movable frame 31 which includes two spaced-apart brace members 32, which are secured to a horizontal back member 33 which extends the width of the chair and thus is seen in section in FIG. 3. The tops of the rearward support members (at the right in FIG. 3) are secured to the brace members 32. Extending forwardly from each back member 33 is a frame member 34, to the forward end of which is secured the top of the respective front support member 30 (at the left in FIG. 3). Extending upwardly from the forward end of each frame member 34 is a vertical member 35 which supports at the top the forward end of an arm member 36. The rearward end of the arm member 36 is secured to the upper part of the respective brace member 32.

Extending in a horizontal plane under and connected to frame members 34 is a panel 37, seen in section in FIG. 3. Extending laterally along the top of, and secured to, the panel 37 are two stiffening members 38 and 39. To the leftward stiffening member 38 is hingedly connected a seat panel 40, which can pivot in the sense shown by the arrows **40*a*. The panel 40 supports a seat cushion 41, which pivots therewith. Extending upwardly and rearwardly, and connected to the brace members 32, is a back support panel 42, to which a back support cushion 43** is secured.

Figure 4:
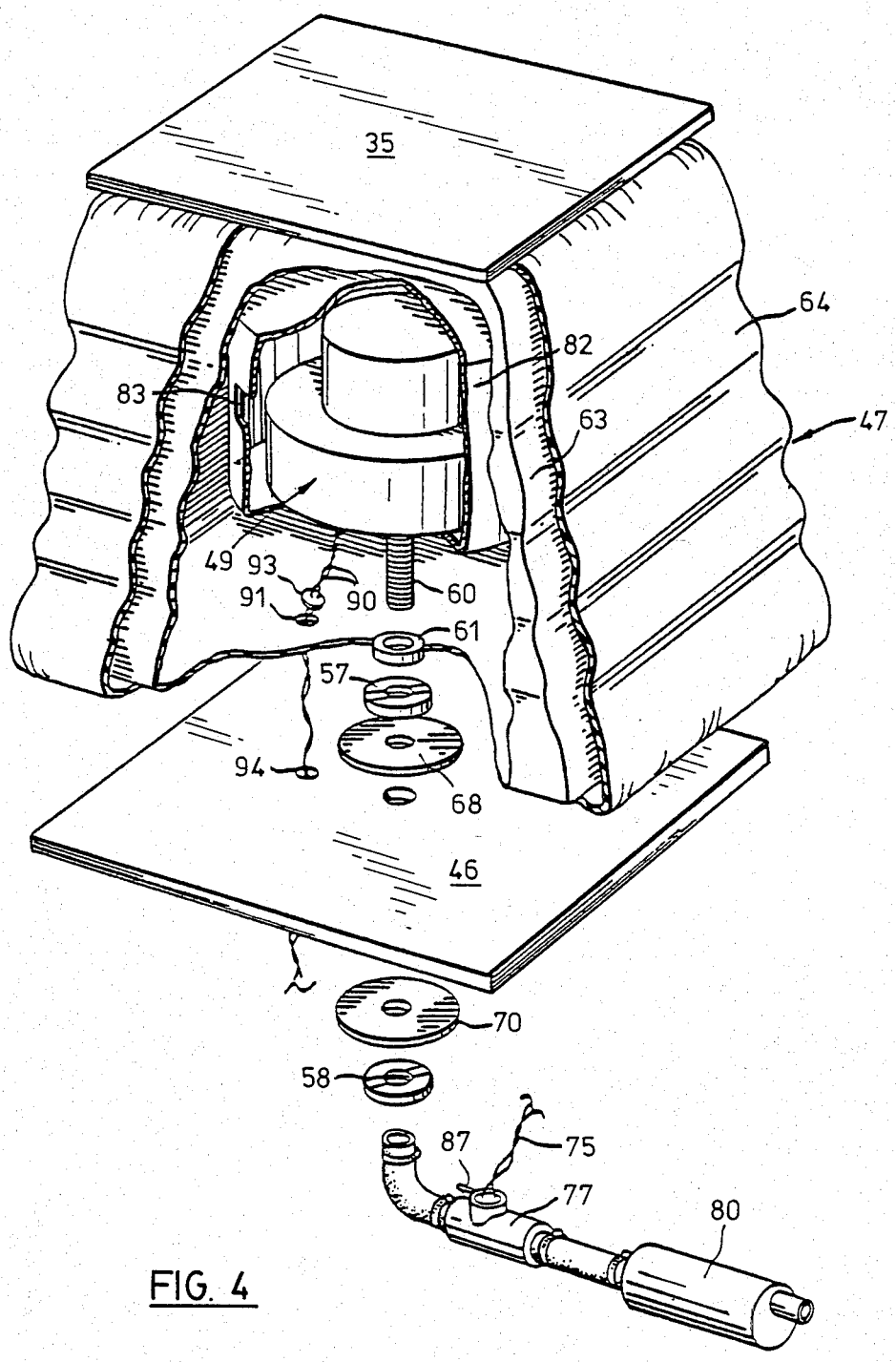
FIG. 4 is an exploded and partly broken-away perspective view of the essential operative portions of the chair of this invention.

Turning now to FIGS. 3 and 4, it will be seen that two cross braces 44 are secured within the base 22, the cross braces 44 conveniently being of wood. Spanning between the cross braces 4 is a partition 46 which supports the bottom of an inflatable member shown generally by the numeral 47. Within the inflatable member 47 are provided means for drawing outside air into the inflatable member to inflate it and to raise the seat portion 14. More specifically, a motorized vacuum-producing device shown generally at 49 is located within the inflatable member 47, the device 49 typically being, or having the same construction as, a small vacuum-cleaner unit. Specifically, the device 49 includes an electric motor within a housing 50, and an air impeller within a housing 52, the device being arranged so that it draws air in through a central bottom opening and expels air through the armature, passing out the top of the housing 50.

Secured against the housing 52 concentric with the central lower opening thereof is a nut 55 which has the same construction as nuts 57 and 58 shown in both FIGS. 3 and 4. Specifically, the nut 55 has a central threaded opening and is essentially disk-like in shape with means by which the nut 55 can be engaged by a turning device. In actual fact, the means for turning is not essential for the nut 55, since it is securely affixed as by bolts, welding or the like to the bottom of the housing 52. This will mean that air drawn in by the device 49 will all pass through the threaded opening in the nut 55. Into this threaded opening is threaded the end of a short threaded pipe 60, the threaded joint being made substantially air-tight with caulking compound or the like.

Sandwiched in air-tight manner between the nuts 55 and 57 is a resilient plastic annulus 61, which may be the outer portion of a conventional Roberts valve of the kind used in inflatable plastic toys and the like. Connected in sealed manner to the annulus 61 is an inner, air-tight bag 63, forming one portion of the inflatable member 47. Surrounding the inner bag 63 is an outer bag 64 which need not be air-impermeable, but which is both flexible and resistant to stretching. For example, a woven fabric may be utilized for the outer bag 64 while a plastized, air impermeable fabric may be utilized for the inner bag 63. It will be noted in FIG. 3 that the outer bag 64 terminates at the bottom in a relatively large opening 66, surrounding the annulus 61. The outer bag 64 is tacked in place against the panels 37 and 46, as shown.

Located below the nut 57 is a rubber disk 68, which is directly in contact with the partition 46. Below the partition 46 is another rubber disk 70, and beneath the disk 70 is the third nut 58. As can be seen, the threaded pipe 60 extends through all of these members, and projects below the nut 58 and the partition 46. The pipe 60 is hollow, in order to allow air to be drawn in by the device 49, and the lower end of the pipe 60 is connected to a short flexible tube 71 by a conventional adjustable clamp 72.

The other end of the tube 71 (the lower end in FIG. 3) is connected to a solenoid-controlled valve 73 of conventional construction. Wires 75 control the solenoid which in turn controls the valve. The valve 73 is closed when not energized, and opens under electrical energization. The valve 73 connects the tube 71 to a further tube 77, which is in turn connected to a muffler 80 which may be of any conventional construction. All of the components 71, 73, 77 and 80 are located in the space beneath the partition 46, as can be seen in FIG. 3.

Shown in FIG. 4 is an additional muffling device 82, although this device has not been illustrated in FIG. 3. The device 82 is optional, and may be employed where additional muffling capability is required. The device 82 may typically be constructed of sheet lead, in the form of a closed hollow cylinder surrounding the device 49, and having at least one window 83 to allow air to pass from the device 49 into the interior of the inner bag 63.

Figure 5:
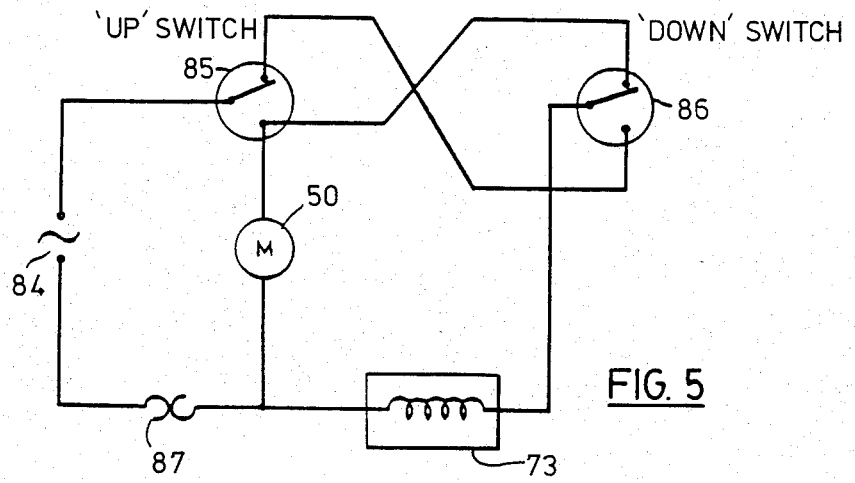
FIG. 5 is a wiring diagram suitable for use in the chair of this invention.

Attention is now directed to FIG. 5 which illustrates a suitable wiring diagram for the electrical portions of the chair herein disclosed. In FIG. 5, a convention A.C. source is designated at the numeral 84, and there are provided two switches 85 and 86, each of which is a single-pole, double-throw switch. The switch 85 is the "up" switch intended to initiate ascent of the chair, whereas the "down" switch 86 is intended to initiate descent of the chair. Each of the switches 85 and 86 is illustrated in its "rest" position, and manual manipulation for each switch will move it so that the contact shifts to the other pole. In FIG. 5, the numeral 87 designates a bi-metallic safety device, which is shown in both FIGS. 3 and 4 in association with the solenoid valve 73. In the event that the solenoid valve 73 overheats due to long continuous use, the safety device 87 will break contact and shut the system down until the solenoid valve 73 cools down.

In FIG. 5 the motor is designated at 50, and the solenoid coil has been placed in a box labeled 73.

With the connections shown in FIG. 5, it will be evident that, so long as both switches 85 and 86 remain in the positions shown in FIG. 5, neither the motor 50 nor the solenoid coil 73 will be energized. By flipping the "up" switch 85 to its alternate position, both the motor 50 and the solenoid coil 73 will be energized. In effect, they will be in parallel with each other between the contacts of the alternating current source 84. The protective device 87 is normally a short circuit unless it is activated by increased temperature, at which point the circuit opens.

If the "down" switch 86 is flipped to its alternate position the motor 50 will not be energized, but the solenoid coil 73 will be energized. If both switches are accidently flipped to their alternate positions, the motor will be energized but the solenoid will not be energized.

Since energization of the solenoid 73 opens the passageway in the center of the pipe 60, and thus allows air into the bag 63, it will be appreciated that activation of the "up" switch 85 will allow the device 49 to draw air into the bag 63, inflate the same, and press upwardly against the underside of the panel 35, thus raising the seat portion 14. Assuming now that the seat portion is in the raised position with the bag 63 fully inflated, it will be realized that the activation of the "down" switch 86 and deactivation of the "up" switch 85 will open only the solenoid valve without energizing the motor, thus allowing the air trapped in the bag 63 to bleed out of the bag through the muffler 80, thus permitting gradual deflation and the lowering of the seat portion 14.

In the event of accidently tripping both switches 85 and 86 at once, the motor 50 will run, and the device 49 will attempt to draw air into the bag 63, but it will be unable to do so because the solenoid valve 73 will not be open.

Returning to FIG. 4, the wires for energizing the device 49 are shown at 90, and pass through a further off-center Roberts valve 91, or more specifically through the closure cap 93 of the Roberts valve 91. The wires 90 are sealed through two apertures in the closure 93, so that when the closure is put into place in the Roberts valve 91, no air leakage will occur across this device. The partition 46 also has an off-center opening 94 to allow the wires 90 to pass through.

It will be appreciated that the motorized vacuum device could be muffled by the bag without being literally within the bag, provided the bag were constructed to fold around or envelop the device.

A simplified version of the control system for the chair is one in which no valve 73 is provided, and in which a single on-off switch controls the motor 50. In this simplified version, the seat would settle back down automatically after each "lift", because as soon as the motor is turned off, the air contained in the inflatable member 47 would pass out through the pipe 60.

Though not illustrated, it would be possible to incorporate in the chair construction a means for automatically shutting down the motor when a certain preselected height is attained. This could be done by providing a chain or cord with one end attached to the seat portion, and the other end adapted to throw a switch which breaks the motor circuit.

It will be appreciated that, although the mechanism herein disclosed has been described in particular relation to a chair, the same mechanism could be utilized to selectively raise and lower any load.

In regard to the guide means shown at 30 in FIG. 3, it has been stated earlier that these may conveniently be typical slide rails used in filing cabinets. It has been found that such slide rails, particularly those which utilize ball bearings, are flexible enough and have a low enough friction factor to permit a certain degree of out-of-alignment to take place as the chair is being raised. It will be understood that the weight of a person sitting in the chair while it is being raised may not necessarily be centred, and since the pressure upwardly exerted by the inflatable bag against the panel 37 is not of such a nature as to resist a tendency for the panel 37 to lean to one side under an off-centre weight distribution, it is important for the guide means to be capable of accommodating some misalignment of this kind.

While a specific embodiment of this invention has been illustrated in the attached drawings and described in the foregoing specification, it will be apparent to those skilled in the art that changes and modifications may be made therein, without departing from the essence of this invention as set forth in the accompanying claims.

I claim:

1. A chair comprising:

a seat portion mounted to be movable between a lower position and a higher position, upright guide means for guiding the movement of the seat portion, an inflatable bag under the seat portion adapted, during inflation, to raise the seat portion toward said higher position, and a vacuum-producing motorized device within and enclosed by the bag for drawing air into the bag along a conduit which passes to the exterior of the bag, thereby to inflate the bag and raise the seat portion, whereby noise from the motorized device is muted by the presence of the surrounding bag, and whereby to efficiently use the space under the seat portion for both the bag and the motorized device.

2. The chair claimed in claim 1, in which the conduit has a valve means, the chair further including:

first control means accessible to one seated on said seat portion for opening said valve means and simultaneously energizing said vacuum-producing motorized device, and second control means accessible to one seated on said seat portion for opening said valve means without energizing said vacuum-producing motorized device.

3. The chair claimed in claim 1, in which the bag means includes an inner bag which is flexible and air-impermeable, and an outer bag which is flexible and resists stretching.

4. The chair claimed in claim 1, or claim 2, in which the chair further includes a muffler device connected to said conduit, thereby to further muffle the noise from said motorized means.

5. The chair claimed in claim 1, or claim 2, in which the said motorized means is substantially completely surrounded by an additional noise-muffling housing within said bag means.

6. The chair claimed in claim 1, or claim 2, in which the seat portion is connected to a back portion which moves therewith.

7. The chair claimed in claim 2, in which the first and second control means are on two opposite arms of said chair.

8. The chair claimed in claim 2, in which the upright guide means are typical slide rails used in filing cabinets.

9. The chair claimed in claim 8, in which the slide rails incorporate bearings.

* * * * *